US008172353B2

(12) United States Patent
Sugahara

(10) Patent No.: US 8,172,353 B2
(45) Date of Patent: May 8, 2012

(54) LIQUID DROPLET JETTING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 569 days.

(21) Appl. No.: 12/407,769

(22) Filed: Mar. 19, 2009

(65) Prior Publication Data

US 2009/0237436 A1 Sep. 24, 2009

(30) Foreign Application Priority Data

Mar. 21, 2008 (JP) ..... 2008-072819

(51) Int. Cl.
*B41J 29/393* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS

| | | | | |
|---|---|---|---|---|
| 6,159,394 | A | 12/2000 | Akiyama et al. | |
| 6,280,655 | B1 | 8/2001 | Xu et al. | |
| 6,491,364 | B2 * | 12/2002 | Pietrzyk et al. | 347/21 |
| 6,588,889 | B2 * | 7/2003 | Jeanmaire | 347/77 |
| 2004/0070638 | A1 * | 4/2004 | Takahashi et al. | 347/12 |
| 2006/0109290 | A1 * | 5/2006 | Shamoun et al. | 347/11 |
| 2008/0278548 | A1 * | 11/2008 | Brost et al. | 347/77 |

FOREIGN PATENT DOCUMENTS

| | | | |
|---|---|---|---|
| JP | H11-334149 | A | 12/1999 |
| JP | 2000-063824 | A | 2/2000 |
| JP | 2001-049251 | A | 2/2001 |
| JP | 2001-064638 | A | 3/2001 |
| JP | 2002-234152 | A | 8/2002 |
| JP | 2002-337339 | A | 11/2002 |
| JP | 2004069483 | A * | 3/2004 |
| JP | 2004333276 | A * | 11/2004 |

* cited by examiner

*Primary Examiner* — Laura Martin
(74) *Attorney, Agent, or Firm* — Baker Botts L.L.P.

(57) ABSTRACT

A liquid droplet jetting apparatus includes a liquid droplet jetting head which is movable in a predetermined scanning direction, and a wind-velocity sensor which measures a wind-velocity around the liquid droplet jetting head. A drive signal to be supplied to the liquid droplet jetting head is adjusted based on the wind-velocity information obtained by the wind-velocity sensor. Accordingly, it is possible to provide a liquid droplet jetting apparatus which is capable of suppressing a shift in a landing position of liquid droplets, which is due to a wind-velocity around the liquid droplet jetting head.

19 Claims, 17 Drawing Sheets

LIQUID DROPLET JETTING APPARATUS

CROSS REFERENCE TO RELATED APPLICATION

The present application claims priority from Japanese Patent Application No. 2008-072819, filed on Mar. 21, 2008, the disclosure of which is incorporated herein by reference in its entirety.

BACKGROUND OF THE INVENTION

1. Field of the Invention

The present invention relates to a liquid droplet jetting apparatus which jets liquid droplets.

2. Description of the Related Art

A liquid droplet jetting apparatus which carries out printing of an image and a wiring pattern on an object surface by jetting liquid droplets on to an object such as a recording medium and printed substrate (board) has hitherto been known. For example, Japanese Patent Application Laid-open No. H11-334149 discloses a printing apparatus of an ink-jet recording type (an ink-jet recording printer) which includes a carriage moving in a scanning direction which is orthogonal to a transporting direction of a recording medium, and an ink-jet head (a printing head) which is mounted on the carriage.

In this printing apparatus, a desired image etc. is printed on the recording medium by jetting ink droplets onto the recording medium while moving the ink-jet head together with the carriage in the scanning direction. Furthermore, this printing apparatus is capable of detecting successively, information of velocity of the carriage in the scanning direction, and correcting a landing position upon adjusting a timing of jetting droplets by the ink-jet head based on the information of velocity when the velocity of the carriage has changed.

SUMMARY OF THE INVENTION

Incidentally, in recent years, it has been sought that a liquid droplet jetting apparatus is capable of jetting extremely small liquid droplets (such as extremely small liquid droplets of less than 1 pl) in order to realize a printing of a high-resolution (highly defined) image and a printing pattern. However, in a liquid droplet jetting head which jets such extremely small droplets of liquid, an effect of an air flow around the head which has not been much problem with a size of the liquid droplets hitherto been used, cannot be ignored. In other words, smaller the liquid droplets to be jetted, the droplets of liquid are more susceptible to be flowed by the air flow around the head, and actual landing position of droplets is shifted from the desired position.

A printing apparatus in the abovementioned Japanese Patent Application Laid-open No. H 11-334149 corrects the landing position of the liquid droplets based on a velocity of the carriage (ink-jet head) in the scanning direction. However, the printing apparatus does not correct the landing position by considering the air flow (wind velocity) around the ink-jet head (particularly, near a liquid droplet jetting surface). In other words, the wind velocity around the ink-jet head fluctuates according to various factors such as scanning of the carriage, transporting of a recording medium, wavering (shaking) of tubes and cables etc. connected to the ink-jet head, or an inflow of air from an outside of the printing apparatus, and it is difficult to estimate that the effect of the wind velocity can be considered sufficiently only by (taking into consideration) the scanning velocity of the carriage.

An object of the present invention is to provide a liquid droplet jetting apparatus which is capable of suppressing the shift in the landing position of the droplets of liquid due to the wind velocity around a liquid droplet jetting head.

According to a first aspect of the present invention, there is provided liquid droplet jetting apparatus which jets a liquid droplet onto a medium, including:

a liquid droplet jetting head having a liquid droplet jetting surface having a nozzle through which the liquid droplet are jetted;

a wind-velocity detecting mechanism which measures a wind velocity at an area around the liquid droplet jetting head; and a jetting control mechanism which controls a liquid droplet jetting operation of the liquid droplet jetting head, and which adjusts a drive signal for driving the liquid droplet jetting head based on the wind-velocity measured by the wind-velocity detecting mechanism.

According to an aspect of the present invention, the jetting control mechanism is capable of suppressing a shift in a landing position of liquid droplets due to an effect of a wind-velocity around the liquid droplet jetting head by adjusting the drive signal to be supplied to the liquid droplet jetting head, based on the wind-velocity information obtained by the wind-velocity detecting mechanism. Around the liquid droplet jetting head refers to an area around a liquid droplet jetting surface, a surface on an opposite side of the liquid droplet jetting head, and a side surface of the liquid droplet jetting head.

According to the present invention, it is possible to suppress the shift in the position of landing of the liquid droplets due to the effect of the wind-velocity around the liquid droplet jetting head by adjusting the drive signal to be supplied to the liquid droplet jetting head, based on the wind-velocity information obtained by the wind-velocity detecting mechanism.

DETAILED DESCRIPTION OF THE PREFERRED EMBODIMENTS

An embodiment of the present invention will be described below. The embodiment is an example in which the present invention is applied to a printer which prints a desired pattern by jetting ink droplets onto a printing medium.

Figure 1:
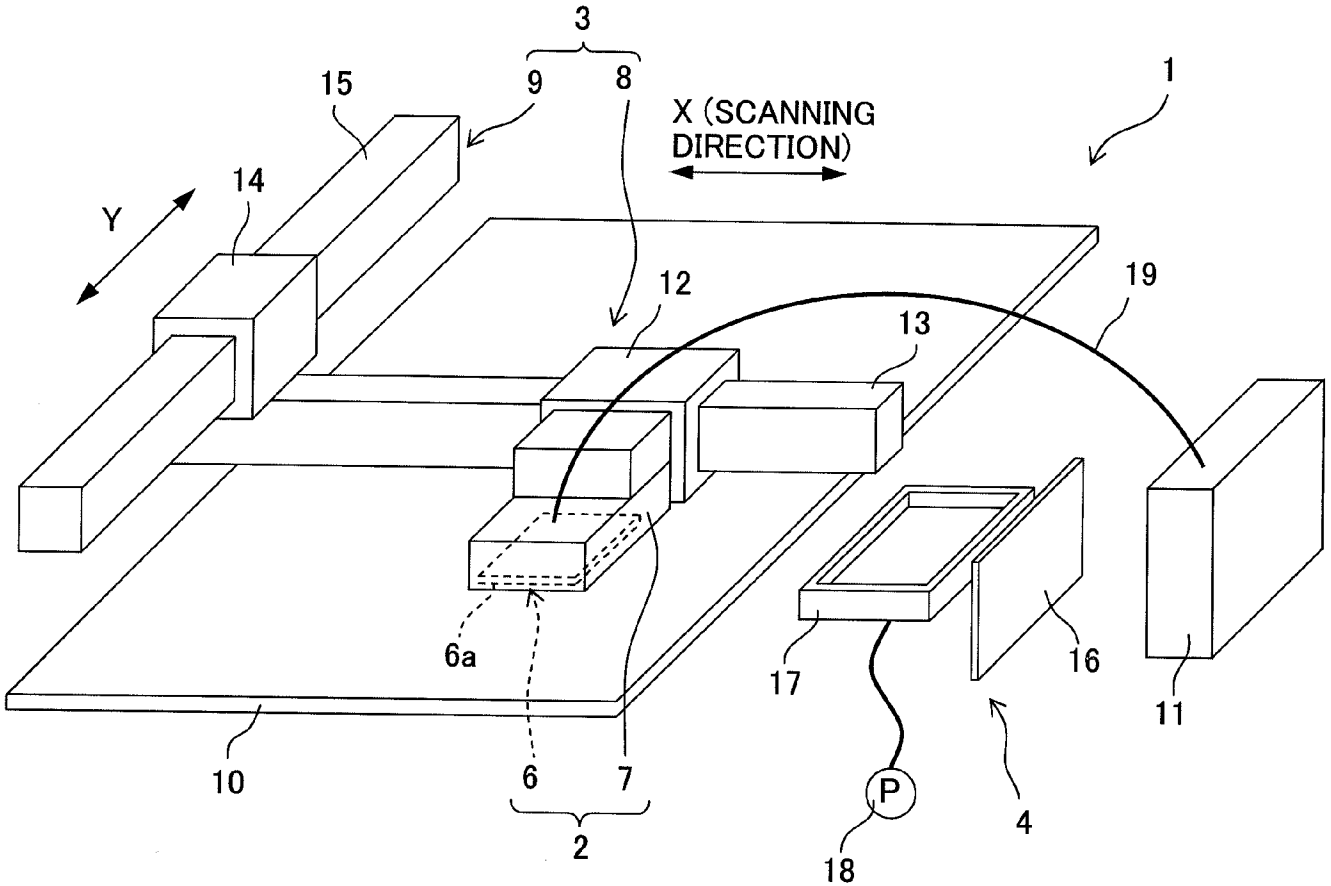
FIG. 1 is a schematic structural view of a printer according to an embodiment of the present invention.

FIG. 1 is a schematic structural view of a printer according to the embodiment. As shown in FIG. 1, a printer 1 (liquid jetting apparatus) includes an ink-jet head 2 (liquid droplet jetting head) which jets ink droplets toward a printing medium 10, a head moving mechanism 3 which moves the ink-jet head 2 in X direction (scanning direction) and Y direction orthogonal to X direction, a maintenance mechanism 4 which carries out maintenance of the ink-jet head 2, and a control unit 5 which controls the overall printer 1 (refer to FIG. 8). A vertical direction in FIG. 1 is defined as a vertical direction in the following description.

The ink-jet head 2 includes a head main body 6 in which a plurality of nozzles 40 is formed in a lower surface (liquid droplet jetting surface 6*a*) facing the printing medium 10 (refer to diagrams from FIGS. 5 to 7), and a head holder 7 which holds the head main body 6. Moreover, the ink-jet head 2 is connected to an ink cartridge 11 which stores the ink, and the ink is supplied to the ink-jet head 2 from the ink cartridge 11 via a tube 19.

The head moving mechanism 3 has an X-direction moving mechanism 8 which drives the ink-jet head 2 in X direction, and a Y-direction moving mechanism 9 which drives the ink-jet head 2 in Y direction. The X-direction moving mechanism 8 includes an X-movable body 12 which is connected to the head holder 7 of the ink-jet head 2, and a guide member 13 which guides the X-movable body 12 in X direction. The ink-jet head 2 and the X-movable body 12 are moved integrally in X direction 12 along the guide member 13 by a motor. Moreover, the Y-direction moving mechanism 9 includes a Y-movable body 14 which is connected to the guide member 13 of the X-direction moving mechanism 8, and a guide member 15 which guides the Y-movable body 14 in Y direction, and moves the ink-jet head 2 together with the X-direction moving mechanism 8 (the X-movable body 12 and the guide member 13) in Y direction.

The ink-jet head 2 jets ink droplets onto the printing medium 10 which is stationary, while moving in X direction upon being driven by the X-direction moving mechanism 8. Moreover, when one time of scanning (one pass) in X direction is completed, the ink-jet head 2 is moved by a predetermined distance in Y direction on the printing medium 10 by the Y-direction moving mechanism 9, and the next scanning in X direction and liquid droplet jetting is carried out.

The maintenance mechanism 4 includes a wiper 16, a purge cap 17, and a suction pump 18, which are arranged in an area on an outer side in X direction (scanning direction), of an area in which the printing medium 10 is arranged.

The wiper 16 is fixed to a main body of the apparatus not shown in the diagram. Moreover, the wiper 16 makes a contact with a liquid droplet jetting surface 6*a* (a lower surface of the head main body 6 in which the nozzles 40 are arranged). In this state, when the ink-jet head 2 has moved in X direction with respect to the wiper 16, the wiper 16 moves relatively in X direction with respect to the liquid droplet jetting surface 6*a*, and wipes off the ink adhered to the liquid droplet jetting surface 6*a* (wiping).

The purge cap 17 is connected to the suction pump 18 via the tube. When there is a jetting defect in a certain nozzle 40 of the ink-jet head 2 due to mixing of an air bubble or an impurity, a suction operation is carried out by driving the suction pump 18 while the liquid droplet jetting surface 6*a* of the ink-jet head 2 is covered by the purge cap 17. Accordingly, the jetting defect of the nozzle 40 is rectified by discharging the air bubble or the impurity together with the ink from the nozzle 40 to the purge cap 17 (suction purge).

Figure 2:
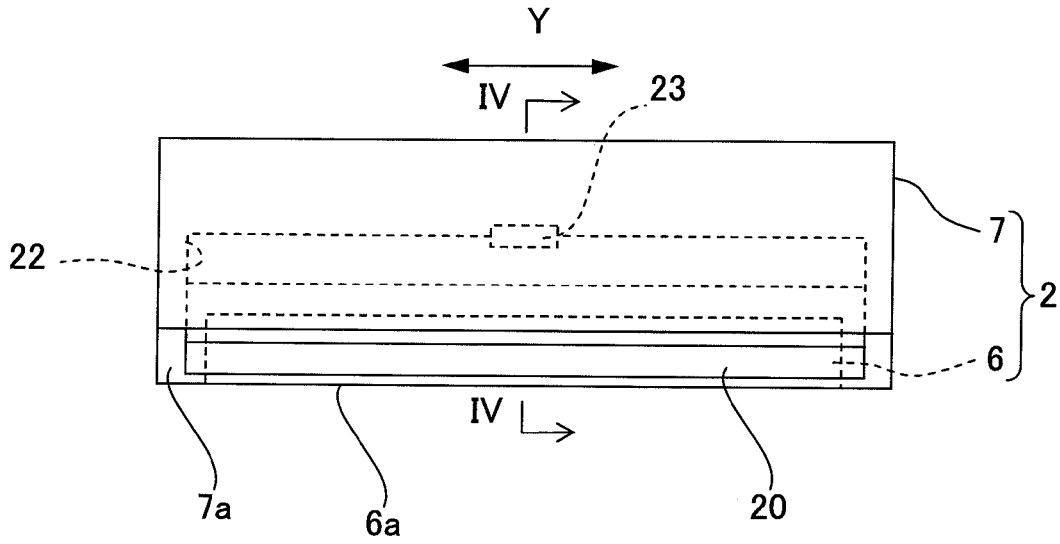
FIG. 2 is a side view in X direction of an ink-jet head.

Next, the ink-jet head 2 will be described below in detail. FIG. 2 is a side view in X direction of the ink-jet jet head 2, FIG. 3 is a cross-sectional view related to a vertical plane) parallel to Y direction (a surface parallel to a paper surface), and FIG. 4 is a cross-sectional view taken a IV-IV line.

Figure 3:
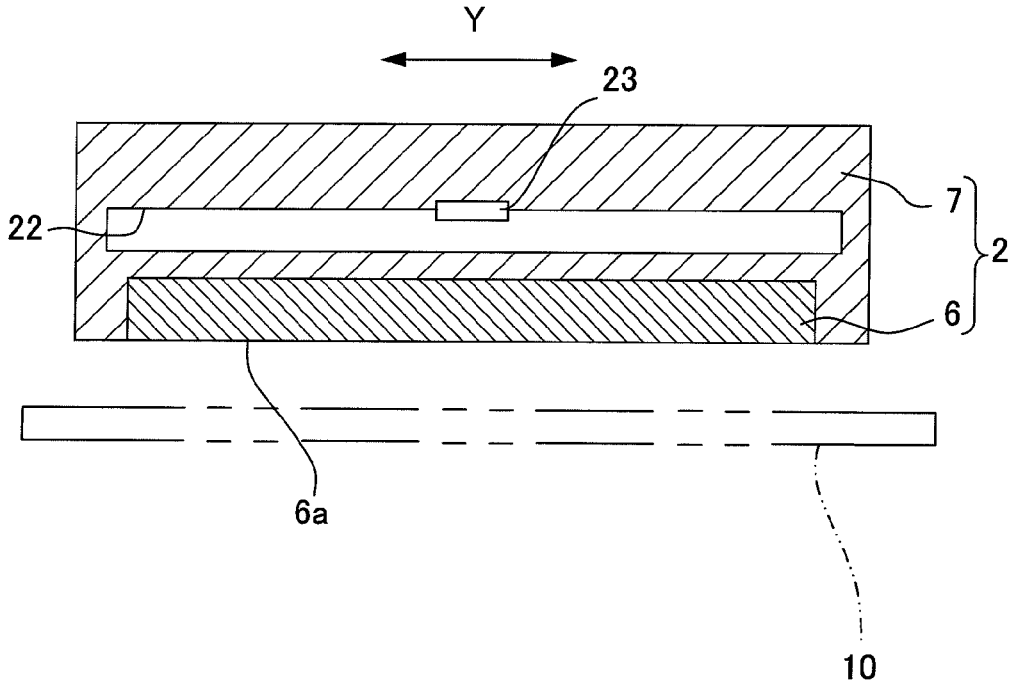
FIG. 3 is a cross-sectional view related to a vertical plane parallel to Y direction, of the ink-jet head.
Figure 4:
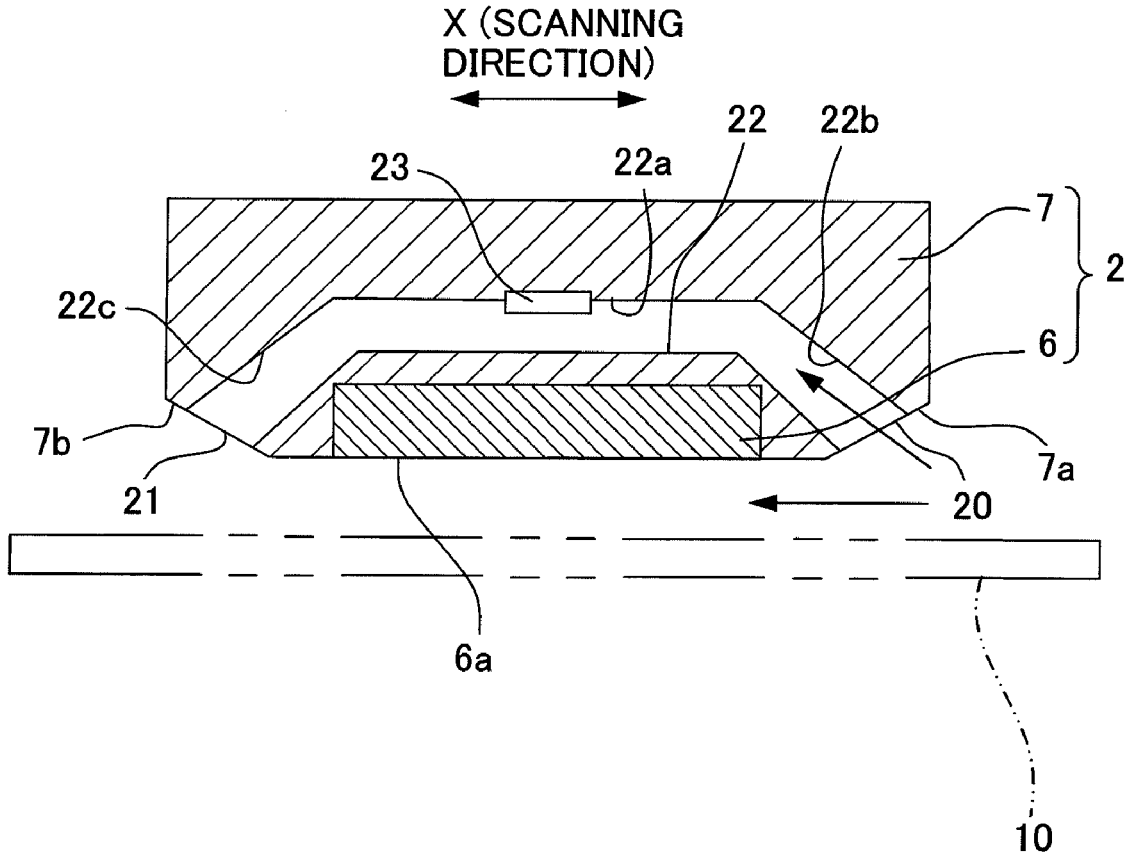
FIG. 4 is a cross-sectional view taken along a line IV-IV in FIG. 2.

As shown in diagrams from FIGS. 2 to 4, the ink-jet head 2 has the head main body 6, and the head holder 7 having a substantially rectangular shape which holds the head main body 6. The head main body 6 is provided at a lower portion of the head holder 7, and a lower surface thereof is the liquid droplet jetting surface 6*a* facing the printing medium 10.

The head holder 7 is provided with air inlet and outlet ports 20 and 21, and an air channel 22 which is extended along X direction to connect the two air inlet and outlet ports 20 and 21. Furthermore, a wind velocity sensor 23 which detects a flow velocity (wind velocity) of air infused into the air channel 22 is provided inside the air channel 22. A structure related to the wind velocity sensor 23 etc., and a reason for the wind velocity sensor 23 being provided to the ink-jet head 2 will be described later in detail.

Figure 5:
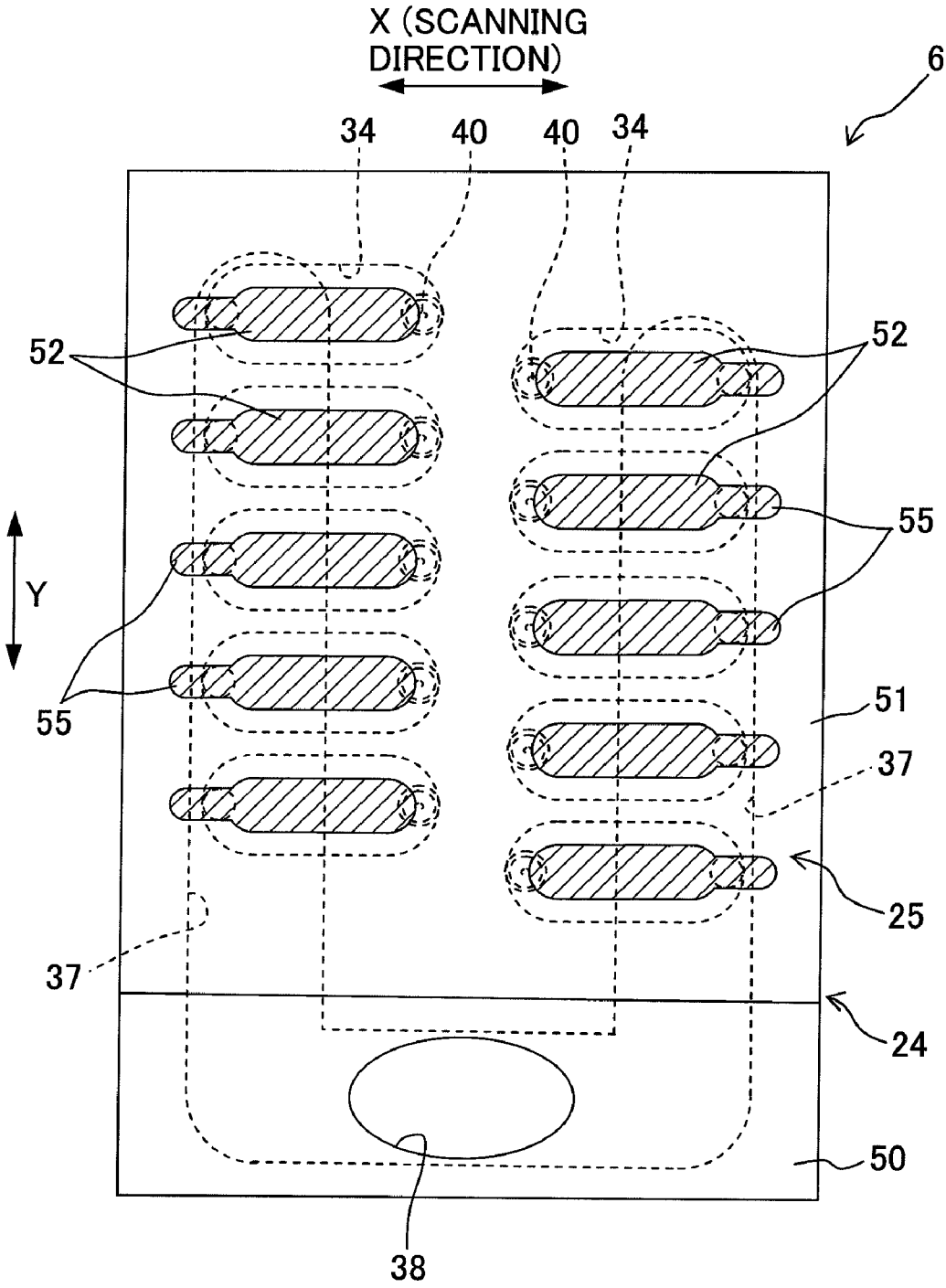
FIG. 5 is a plan view of a head main body.
Figure 6:
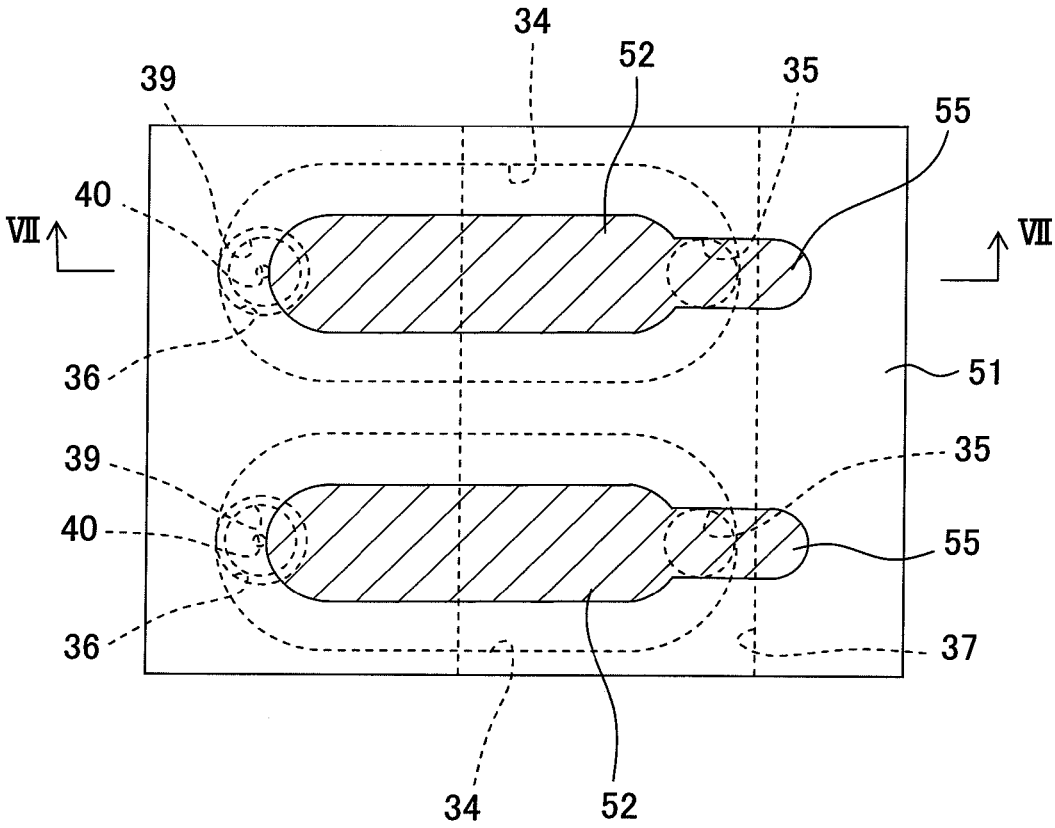
FIG. 6 is a partially enlarged view of the head main body in FIG. 5.
Figure 7:
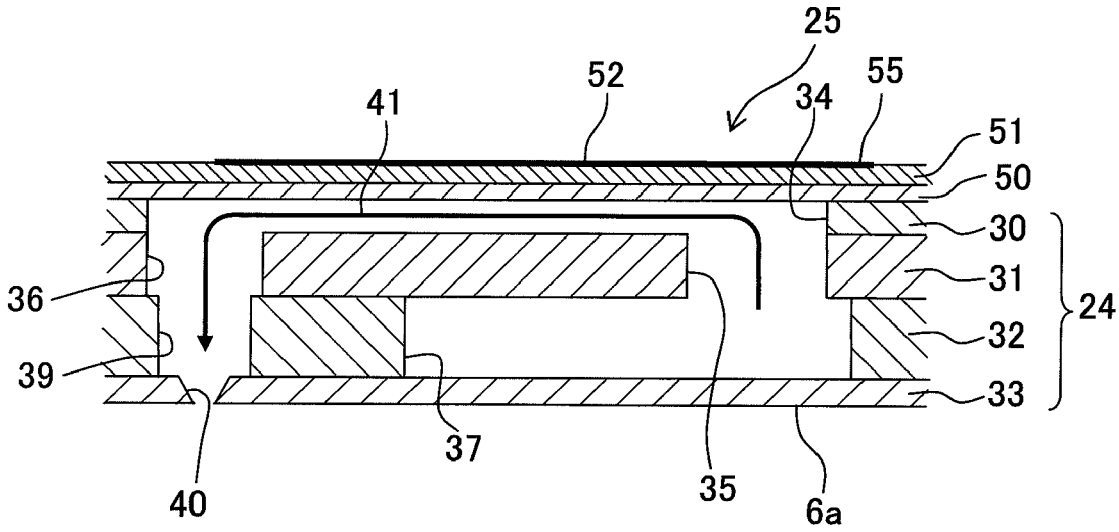
FIG. 7 is a cross-sectional view taken along a VII-VII line in FIG. 6.

Next, the head main body 6 will be described below. FIG. 5 is a plan view of the head main body 6, FIG. 6 is a partially enlarged view of FIG. 5, and FIG. 7 is a cross-sectional view taken along a VII-VII line in FIG. 6. As shown in diagrams from FIGS. 5 to 7, the head main body 6 includes a channel unit 24 in which ink channels including the nozzles 40 and pressure chambers 34 are formed, and an actuator unit 25 of a piezoelectric type which applies a pressure to the ink in the pressure chamber 34.

Firstly, the channel unit 24 will be described below. As shown in FIG. 7, the channel unit 24 includes a cavity plate 30, a base plate 31, a manifold plate 32, and a nozzle plate 33, and these four plates 30 to 33 are joined in a stacked form. Among these four plates 30 to 33, the cavity plate 30, the base plate 31, and the manifold plate 32 are substantially rectangular plates made of a metallic material such as stainless steel. Therefore, it is possible to form the ink channels such as the pressure chamber 34 and a manifold which will be described later, in these three plates 30 to 32 easily by an etching. The nozzle plate 33 is formed of a high-molecular synthetic resin material such as polyimide, and is joined to a lower surface of the manifold plate 32. Or, the nozzle plate 33 also may be formed of a metallic material such as stainless steel similarly as the other three plates 30 to 32.

As shown in diagrams from FIGS. 5 to 7, a plurality of pressure chambers 34 arranged in a row along a plane is formed by holes cut through the cavity plate 30 which is positioned at the top of the four plates 30 to 33. The pressure chambers 34 are arranged in two rows in a zigzag form in Y direction (vertical direction in FIG. 5). As shown in FIG. 5, the pressure chambers 34 are covered from both an upper side and a lower side by the base plate 31 and a vibration plate 50 which will be described below. Each pressure chamber 34 is formed to be substantially elliptical shape with a longer side of the ellipse in X direction (left-right direction in FIG. 5) in a plan view.

As shown in FIGS. 6 and 7, communicating holes 35 and 36 are formed in the base plate 31 at positions overlapping with both end portions in a longitudinal direction of the pressure chambers 34 in a plan view. Two manifolds 37 extended in a transport direction are formed in the manifold plate 32 such that each of the manifolds 37 overlaps with the pressure chambers 34, arranged in two rows in a plan view, at a portion thereof on a side of the communicating hole 35. These two manifolds 37 communicate with an ink supply port 38 formed in the vibration plate 50 which will be described later, and the ink is supplied from an ink tank (not shown in the diagram) to the manifold 37 via the ink supply port 38. A plurality of communicating holes 39 communicating with the communicating holes 36 respectively are formed in the manifold plate 32, at positions overlapping with an end portion of the pressure chambers 34, on an opposite side of the manifold 37 in a plan view.

The nozzles 40 are formed in the nozzle plate 33, at positions overlapping with the communicating holes 39 respectively in a plan view. A lower surface of the nozzle plate 33 is the liquid droplet jetting surface 6*a* in which the nozzles 40 are arranged. As shown in FIG. 5, the nozzles 40 are arranged to overlap with end portions of the pressure chambers 34 arranged, on an opposite side of the manifold 37, in two rows along the transport direction.

As shown in FIG. 5, the manifolds 37 communicates with the pressure chambers 34 via the communicating holes 35, and further, the pressure chambers 34 communicates with the nozzles 40 via the communicating holes 36 and 39. In such manner, a plurality of individual ink channels 41 from the manifolds 37 up to the nozzles 40 via the pressure chambers 34 is formed in the channel unit 24.

Next, the actuator unit 25 of piezoelectric type will be described below. As shown in diagrams from FIGS. 5 to 7, the actuator unit 25 includes the vibration plate 50 which is arranged on an upper surface of the channel unit 24 (cavity plate 30) to cover the pressure chambers 34, a piezoelectric layer 51 which is arranged on an upper surface of the vibration plate 50, facing the pressure chambers 34, and a plurality of individual electrodes 52 which is arranged on the upper surface of the piezoelectric layer 51.

The vibration plate 50 is a metal plate having a substantially rectangular shape in a plan view, and is made of an alloy of iron (an iron alloy) such as stainless steel, an alloy of copper (a copper alloy), an alloy of nickel (a nickel alloy), or an alloy of titanium (a titanium alloy). The vibration plate 50 is joined to the cavity plate 30 to cover the pressure chambers 34, on an upper surface of the cavity plate 30. Moreover, the upper surface of the vibration plate 50 which is electroconductive also serves as a common electrode. In other words, since the upper surface of the vibration plate 50 is arranged on a lower-surface side of the piezoelectric layer 51, an electric field in a direction of thickness in the piezoelectric layer 51 is generated between the individual electrodes 52 on the upper surface. The vibration plate 50 as a common electrode, is connected to a ground wire of a driver IC 57 (refer to FIG. 8) which drives the actuator unit 25, and is kept at a ground electric potential all the time.

The piezoelectric layer 51 is made of a piezoelectric material which is principally composed of lead zirconate titanate (PZT) which is a solid solution of lead titanate and lead zirconate, and which is a ferroelectric substance. As shown in FIG. 5, the piezoelectric layer 51 is formed on the upper surface of the vibration plate 50, to be continuously spread over the pressure chambers 34. Moreover, the piezoelectric layer 51 is polarized in a thickness direction thereof in an area facing at least the pressure chambers 34.

The individual electrodes 52 are arranged on an upper surface of the piezoelectric layer 51, in an area facing the pressure chambers 34. Each of the individual electrodes 52 has a substantially elliptical shape slightly smaller than the pressure chambers 34, and is facing a central portion of one of the pressure chamber 34. Moreover, a plurality of contact portions 55 is drawn from end portions of the individual electrodes 52 along a longitudinal direction of the individual electrodes 52. The contact portions 55 are electrically connected to the driver IC 57 via a flexible printed circuit (FPC) which is not shown in the diagram (refer to FIG. 8). The driver IC 57 supplies a drive signal including a drive pulse to each of the individual electrodes 52 (refer to FIG. 9). In other words, the driver IC 57 switches an electric potential of the individual electrodes to one of a predetermined driving electric potential and a ground electric potential.

Next, an action of the actuator unit 25 at the time of jetting ink will be described below. When a predetermined driving electric potential is applied to a certain individual electrode 52 from the driver IC 57, an electric potential difference is developed between the individual electrode 52 to which the driving electric potential is applied, and the vibration plate 50 as a common electrode which is kept at the ground electric potential, and an electric field in a thickness direction thereof acts in the piezoelectric layer 51 sandwiched between the individual electrode 52 and the vibration plate 50. Since a direction of the electric field generated in the piezoelectric layer 51 is parallel to a direction in which the piezoelectric layer 51 is polarized, the piezoelectric layer 51 in an area (an active area) facing the individual electrode 52 contracts in a in-plane direction which is orthogonal to the thickness direction. Here, since the vibration plate 50 at a lower side of the piezoelectric layer 51 is fixed to the cavity plate 30, with the contraction of the piezoelectric layer 51 positioned on the upper surface of the vibration plate 50 in the planar direction, a portion of the vibration plate 50 covering the pressure chamber 34 is deformed to form a projection toward the pressure chamber 34 (unimorph deformation). In the actuator unit 25 according to the present invention, a stand-by state is maintained till the ink is jetted, with the vibration plate 50 in a deformed state as described above (stand-by state). Next, at the time of jetting the ink, the driver IC 57 stops applying the driving electric potential to the individual electrode 52 from a state in which the driving electric potential is applied to the individual electrode 52. Accordingly, the electric potential of the individual electrode 52 becomes the ground electric potential, and the vibration plate 50 regains its original shape. Accordingly, the pressure chamber 34 returns to an original volume. In other words, the volume of the pressure chamber 34 increases as compared to the volume in the stand-by state, and a pressure wave is generated in the pressure chamber 34. Here, as it has hitherto been known, when a time for one-way propagation in the longitudinal direction of the pressure wave generated due to the increase in the volume of the pressure chamber 34 has elapsed, a pressure in the pressure chamber 34 changes to positive pressure. Accordingly, the driver IC 57 applies the driving electric potential to the individual electrode 52 at the time at which the pressure wave in the pressure chamber 34 is changed to positive. At this time, since the pressure wave generated with the increase in the volume of the pressure chamber 34 described above and the pressure wave generated at the time of deformation due to the vibration plate 50 being projected toward the pressure chamber 34 are combined, a substantial pressure is applied to the ink in the pressure chamber 34 and the ink is jetted from the nozzle 40.

Incidentally, as it has been described above, when the liquid droplets are jetted from the nozzle 40 by the actuator unit 25, with an influence of air flowing around the ink-jet head 2 (particularly a space between the liquid droplet jetting surface 6*a* and the printing medium 10), a direction of flying of liquid droplets changes and a position of landing of the liquid droplets on the printing medium 10 might be shifted from a desired position. Particularly, when a volume of the liquid droplets is small (when the droplets are extremely small of a size less than 1 pl for example), the liquid droplets are susceptible to be flowed away, and an amount of shift in the landing position also becomes substantial. Moreover, as in the embodiment, in a so-called serial ink-jet head 2 which jets ink droplets while moving in a predetermined scanning direction (X direction), since a wind velocity in a surrounding area thereof becomes substantial (increases) due to the movement of the head in the scanning direction, the liquid droplets are susceptible to an influence of a fluctuation (change) in the wind velocity.

Therefore, as shown in diagrams from FIGS. 2 to 4, the printer 1 of the embodiment includes the wind velocity sensor 23 (wind velocity detecting mechanism, wind velocity measuring mechanism) which measures the wind velocity around the ink-jet head 2 to which the wind velocity sensor 23 is provided, while moving integrally with the ink-jet head 2 in X direction. Here, it is possible to use sensors of various types as the wind velocity sensor 23. It is possible to use a sensor of a thermistor type in which the wind velocity is detected by using a fluctuation (change) in a resistance value of a thermistor due to a heat on a thermistor surface being removed (drawn) by a flow of air. Moreover, the wind velocity sensor 23 is electrically connected to a control unit 5, and wind-velocity information detected by the wind velocity sensor 23 is sent to the control unit 5.

In this manner, as the wind velocity sensor 23 moves integrally with the ink-jet head 2 in X direction, it is possible to detect accurately a flow velocity (wind velocity) of the air around the ink-jet head 2. Particularly, it is possible to detect accurately the flow velocity of air flowing in between the liquid droplet jetting surface 6*a* and the printing medium. Further, by controlling the drive signal from the driver IC 57 based on the wind-velocity information detected by the wind velocity sensor 23, it is possible to suppress the shift in the landing position of of liquid droplets due to the influence of the wind velocity.

Furthermore, the ink-jet head 2 of the embodiment has an arrangement for preventing the ink jetted from the nozzle 40 from being adhered to the wind velocity sensor 23. The concrete structure thereof will be described below in detail.

As shown in diagrams from FIGS. 2 to 4, the head holder 7 is provided with two air inlet and outlet ports 20 and 21 opening on two sides respectively in (of) X direction (scanning direction) of the head holder 7, and the air channel 22 which is extended along X direction to connect the two air inlet and outlet ports 20 and 21. Moreover, the wind velocity sensor 23 is arranged inside the air channel 22.

Accordingly, as it is shown by an arrow in FIG. 4, at the time of jetting the liquid droplets by the ink-jet head 2 while moving in X direction, air which has flowed into the air channel 22 from the outside of the ink-jet head 2 via one of the air inlet and outlet ports 20 and 21, flows through the air channel 22 in X direction and then flows out from the other air inlet and outlet port 20 or 21. The wind velocity at this time is detected by the wind velocity sensor 23 arranged inside the air channel 22. In such manner, since the wind velocity sensor 23 is provided inside the air channel 22, the wind velocity sensor 23 is not exposed to an outside of the ink-jet head 2. Therefore, it is possible to prevent to a possible extent, the ink from making a contact with the wind velocity sensor 23.

As shown in FIG. 4, the air channel 22 has a channel shape symmetrical in X direction with a central portion thereof as a center of symmetry. The wind velocity sensor 23 is provided on an inner surface of the central portion. Therefore, when the ink-jet head 2 moves in one direction in X direction, and a direction opposite to that, the wind velocity inside the air channel 22 doesn't differ much. Consequently, there hardly occurs a difference in wind velocity detection result of the wind velocity sensor 23 provided at the central portion of the air channel 22 according to the direction of movement of the ink-jet head 2. Moreover, the wind velocity sensor 23 is provided particularly to a ceiling surface 22*a* of the inner surface of the air channel 22. Therefore, in case the ink has entered the air channel 22, the ink is hardly adhered to the wind velocity sensor 23.

Moreover, to find correctly the wind velocity near the liquid droplet jetting surface 6*a* which has the maximum effect on a shift in the landing position of liquid droplets, it is preferable that the two air inlet and outlet ports 20 and 21 open near the liquid droplet jetting surface 6*a*. However, an arrangement indispensable for making the liquid droplets jet from the nozzle 40, such as the channel unit 24 and the actuator unit 25 described above exists above the liquid droplet jetting surface 6*a*. Therefore, for such structure not to interfere with the air channel 22, it is necessary that a central portion of the air channel 22 exists at a position away at an upper side from the liquid droplet jetting surface 6*a*. Therefore, in the embodiment, the two air inlet and outlet ports 20 and 21 are arranged at positions on a lower side of the air channel 22 (positions near the liquid droplet jetting surface 6*a*), and channel portions 22*b* and 22*c* communicating with the two air inlet and outlet ports 20 and 21 respectively are extended to be inclined upward from the air inlet and outlet ports 20 and 21, to be away from the liquid droplet jetting surface 6*a*.

Furthermore, as shown in FIG. 4, both end portions in X direction of a lower portion of the head holder 7 are not in the same plane (same surface) as the liquid droplet jetting surface 6*a*. Both end portions of the lower portion of the head holder 7 are inclined to be directed upward (a direction opposite to the liquid droplet jetting direction) with respect to the liquid droplet jetting surface 6*a* of the head main body 6 respectively, as the both end portions are directed outward of the head holder 7 in X direction. The two air inlet and outlet ports 20 and 21 are provided on these two inclined surfaces 7*a* and 7*b*, opening on the two sides in X direction respectively. According to such structure, the two air inlet and outlet ports 20 and 21 are positioned to be separated (to be away) at an upper side of (above) the liquid droplet jetting surface 6*a*, and the ink hardly enters the outside-air channel 22 through the outside-air inlet and outlet ports 20 and 21. In a case of scanning the ink-jet head 2, sometimes a vortex is generated at a rear end of the head holder 7. However, by arranging the air inlet and outlet ports 20 and 21 in such manner, since it is possible to eliminate (make disappear) the vortex by air discharged from the air inlet and outlet ports 20 and 21 upon passing through the air channel 22, it is possible to suppress a turbulence of the flow of air around the ink-jet head 2.

As shown in FIG. 2, as seen from X direction (scanning direction), the air inlet and outlet port 20 (21) and the liquid droplet jetting surface 6*a* overlap with each other. In other words, a horizontal position of the outside-air inlet and outlet port 20 (21) and a horizontal position of the liquid droplet jetting surface 6*a* (a position in a direction parallel to the liquid droplet jetting surface 6*a*) overlap mutually. Accordingly, since a part of the air flowing in near the liquid droplet jetting surface 6*a* can enter the air channel 22 from the air inlet and outlet ports 20 and 21, it is possible to measure correctly the wind velocity near the liquid droplet jetting surface 6*a*. Here, when the air inlet and outlet ports 20 and 21 and the liquid droplet jetting surface 6*a* are at the same position of height (are at the same height), when the wiping is carried out by the wiper 16 of the maintenance mechanism 4 (refer to FIG. 1), the ink wiped off from the liquid droplet jetting surface 6*a* by the wiper 16 is susceptible to enter the air channel 22 from the outside-air inlet and outlet ports 20 and 21. However, as it has been described above, the air inlet and outlet ports 20 and 21 open on the inclined surfaces 7*a* and 7*b* respectively which are inclined upward with respect to the liquid droplet jetting surface 6*a*, provided at both end portions in X direction of the head holder 7. Therefore, the air inlet and outlet ports 20 and 21 are separated on an upward side of the liquid droplet jetting surface 6*a* with which the wiper 16 makes a contact, and the ink wiped off by the wiper 16 hardly enters the air channel 22.

Next, an electrical structure of the printer 1 with the control unit 5 will be described by referring to a block diagram in FIG. 8. The control unit 5 shown in FIG. 8 includes a central processing unit (CPU), a read only memory (ROM) in which various computer programs and data for controlling an overall operation of the printer are stored, a random access memory (ROM) which temporarily stores data to be processed by the CPU, and an input-output (I/O) interface which carries out transceiving of signals to and from an external apparatus (device).

Figure 8:
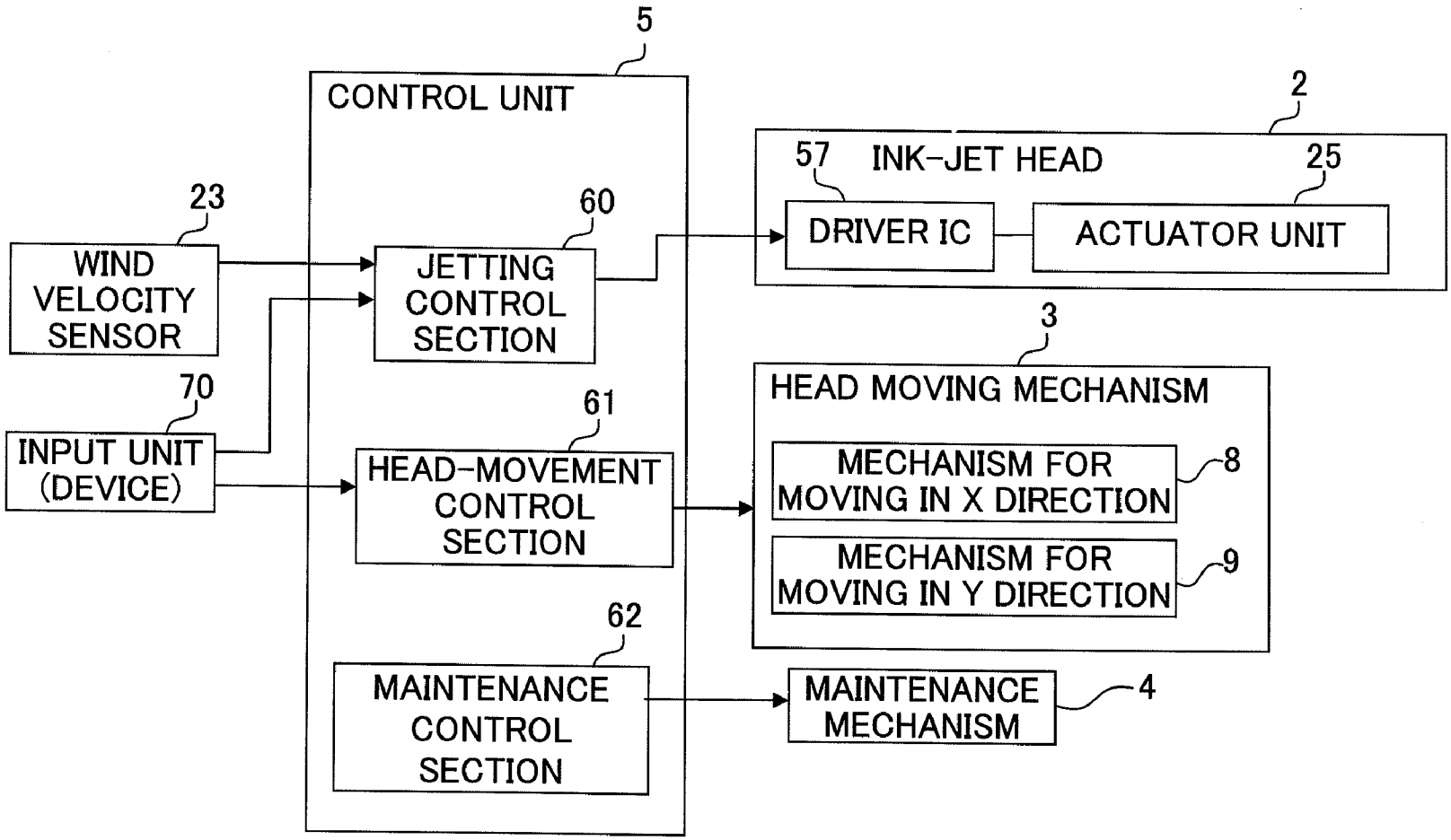
FIG. 8 is a block diagram showing schematically an electrical structure of a printer.

Moreover, as shown in FIG. 8, the control unit 5 includes a jetting control section 60 (jetting control mechanism) which controls a liquid droplet jetting operation of the ink-jet head 2 based on information related to a printing pattern which is input from an input unit (device) 70, a head-movement control section 61 which controls a movement of the ink-jet head 2 in X direction and Y direction by the head moving mechanism 3 based on information related to the printing pattern, and a maintenance control section 62 which controls a maintenance operation (such as suction purge and wiping) of the maintenance mechanism 4. Functions of the jetting control section 60, the head-movement control section 61, and the maintenance control section 62 are realized by the various control programs stored in the ROM of the control unit 5 by being executed by the CPU.

The liquid droplet jetting control of the ink-jet head 2 by the jetting control section 60 will be described below in further detail. The jetting control section 60 sends a control signal to the driver IC 57 of the ink-jet head 2, and makes the driver IC 57 generate a drive signal to be supplied to the actuator unit 25. In other words, the jetting control section 60 supplies the drive signal to the actuator unit 25 of the ink-jet head 2 via the driver IC 57.

Further, the jetting control section 60 controls (adjusts) the drive signal to be supplied to the actuator unit 25 based on the wind velocity information which is detected by the wind velocity sensor 23 such that, the shift in the landing position of the liquid droplets (ink droplets) due to the influence of the wind velocity is suppressed. More concretely, the jetting control section 60 controls (adjusts) a waveform of the drive signal and a voltage value (an electric potential difference between the driving electric potential and the ground electric potential) of the drive signal.

Figure 9A:
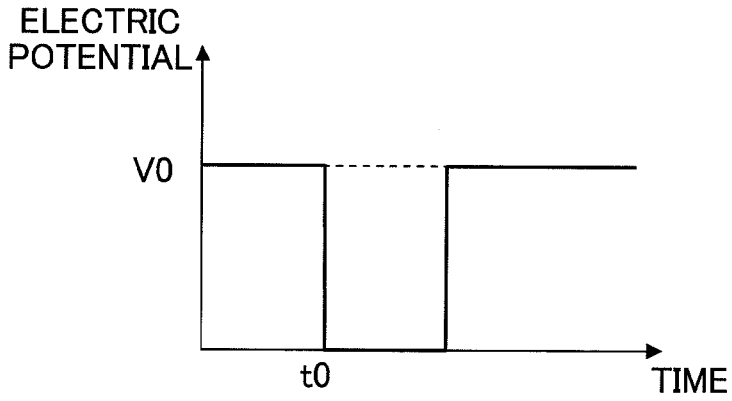
FIG. 9A is a waveform diagram of a drive signal in a state of mindlessness.
Figure 9B:
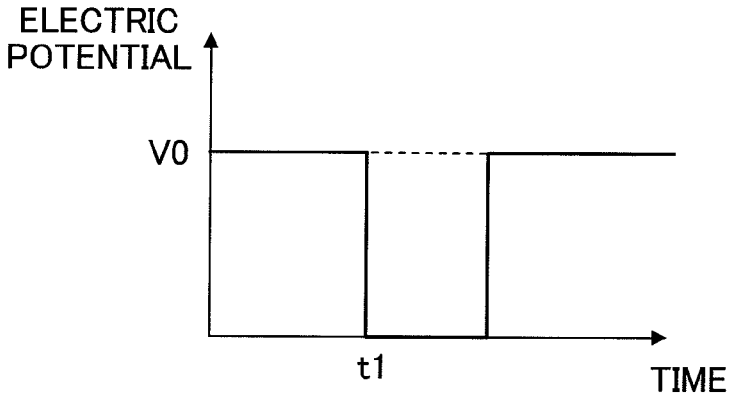
FIGS. 9B and 9C are waveform diagrams of a drive signal when a wind velocity is substantial.

FIGS. 9A and 9B are diagrams showing a waveform of a drive signal supplied to the actuator unit 25. FIG. 9A is a pulse waveform of the drive signal in a state of windlessness. The words "the wind velocity is zero" means not only a perfect windlessness state, but also a state in which the magnitude of the wind velocity is a value smaller than or equal to a predetermined threshold value, and a flow of the air around the ink-jet head 2 has almost no effect on the liquid droplets jetted from the nozzle 40. In the 'windlessness state', a drive pulse is applied to the actuator unit 25 at a predetermined timing t0 as shown in FIG. 9A. In other words, at this timing, the electric potential of the individual electrode 52 is switched from the driving electric potential (V0) to the ground electric potential, and due to the pressure being applied to the ink in the pressure chamber 34, the liquid droplets (droplets of ink) are jetted from the nozzle 40.

On the other hand, when there is a flow of air around the ink-jet head 2, particularly near the liquid droplet jetting surface 6*a*, the liquid droplets jetted from the nozzle are susceptible to be flowed away. Therefore, when the value of the wind velocity detected by the wind velocity sensor 23 is higher than the predetermined value which is a criterion for the 'windlessness state' described above, and the wind velocity is substantial to an extent of having an effect on the liquid droplets, by changing the timing of applying the drive pulse (in other words, jetting timing of liquid droplets), it is possible to suppress the shift in the landing position of the liquid droplets.

In FIG. 9B, an example of the pulse wave of the drive signal when the wind velocity is substantial (high) is shown. For instance, a direction of the wind velocity detected by the wind velocity sensor 23 is opposite to the direction of movement of the ink-jet head 2, the liquid droplets are flowed to an upstream side of the direction of movement of the ink-jet head 2 due to the air flow, and the landing position of liquid droplets is shifted to the upstream side as compared to the landing position in the 'mindlessness state'. For suppressing the shift in the landing position, the timing of liquid droplet jetting may be made slightly later than (the timing) in the 'mindlessness state'. In other words, as shown in FIG. 9B, the drive pulse is applied at a timing t1 later than the timing of applying the pulse in the 'mindlessness state' (timing to) (FIG. 9A), and the electric potential of the individual electrode 52 is switched from the ground electric potential to the driving electric potential (V0) at this timing. Conversely, when the direction of wind velocity is same as the direction of movement of the ink-jet head 2, the landing position is shifted to a downstream side as compared to the position of landing in the 'windlessness state'. For compensating this shift, the timing of liquid droplet jetting is to be made earlier. Therefore, when a direction of wind velocity is same as the direction of movement of the ink-jet head 2, the drive pulse is applied at a timing earlier than the timing of applying the pulse in the 'mindlessness state'.

Figure 9C:
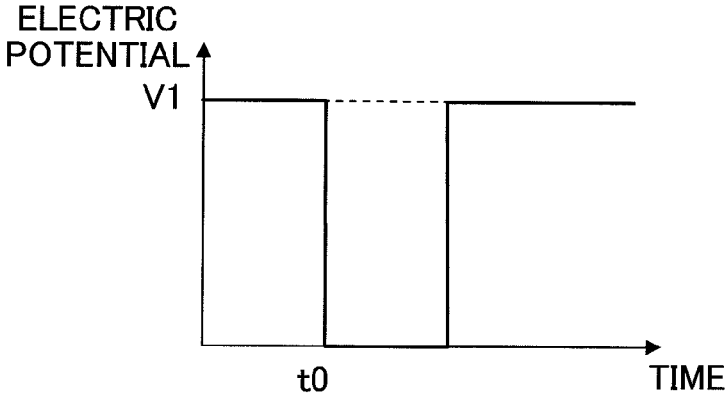

Or, when the wind velocity is substantial, a jetting velocity may be increased by applying a jetting energy higher than the jetting energy on the ink such that the effect of the wind velocity on the liquid droplet jetting direction is small. In FIG. 9C, a pulse waveform of another drive signal when the wind velocity is substantial is shown. When the value of the wind velocity detected by the wind velocity sensor 23 is higher than the predetermined value which is a criterion for the 'mindlessness state', as shown in FIG. 9C, a voltage value V1 of the drive signal (a difference between the ground electric potential and the driving electric potential selectively applied the individual electrode 52) is higher than a voltage value V0 in the 'windlessness state' (FIG. 9A). Accordingly, since the velocity of jetting of liquid droplets from the nozzle 40 becomes high, an effect of the wind velocity on the straightness of the liquid droplets becomes small, and the shift in the landing position of the liquid droplets is suppressed.

A case in which the ink-jet head 2 moves at a velocity of 1 m/s, a gap between the liquid droplet jetting surface 6*a* of the ink-jet head 2 and the printing medium 10 is 1.5 mm, and liquid droplets of a volume 1 pl are jetted is taken into consideration. At this time, in the state of windlessness, when a voltage value of the drive signal is let to be 24V, by making the drive voltage higher by 2V, it is possible to counterbalance the shift in the position of landing equivalent to the wind velocity of 1 m/s.

Moreover, both the adjustment of timing of applying the pulse shown in FIG. 9B and the adjustment of the voltage value shown in FIG. 9C may be carried out simultaneously.

Furthermore, it is also possible to control other parameters related to jetting characteristics of the drive signal based on the wind velocity information which is detected. As such parameter, a width of one drive pulse may be adjusted. Or, at the time of forming one dot, in a case of jetting a plurality of ink droplets by applying a plurality of drive pulses, the number of pulses applied in one jetting cycle (a cycle of forming one dot on the printing medium 10), or a time interval of drive pulses in one jetting cycle may be adjusted.

Next, modified embodiments in which various modifications are made in the embodiment will be described below. Same reference numerals are assigned to components which are similar to the components in the embodiment, and the description of such components is omitted.

First Modified Embodiment

It has been omitted in the embodiment described above, but as shown in FIG. 10, an FPC 71 (wiring member) having a flexibility may be connected to the actuator unit 25 of the head main body 6 of an ink-jet head 2A. Moreover, the driver IC 57 is mounted on the FPC 71. Further, the driver IC 57 is connected to the control unit 5 (refer to FIG. 8) and the actuator unit 25 via a wire in the FPC 71, and based on a control signal received from the control unit 5, supplies a drive signal (drive pulse) to the actuator unit 25 of the head main body 6. Furthermore, the FPC 71 is drawn in Y direction from the head main body 6, and is bent at an upper side (is bent upward) (an opposite side of the direction of jetting with respect to the liquid droplet jetting surface 6*a*).

On the other hand, the wind velocity sensor 23 arranged on the inner surface (ceiling surface 22*a*) of the air channel 22 is positioned at the opposite side of the direction of jetting of liquid droplets with respect to the liquid droplet jetting surface 6*a*, in other words, the wind velocity sensor 23 is positioned at an upper portion of the ink-jet head 2A. Moreover, the FPC 71 drawn in Y direction from the head main body 6, and bent upward is electrically connected to the wind velocity sensor 23, and the wind velocity sensor 23 is connected to the control unit 5 via the wire in the FPC 71.

Figure 10:
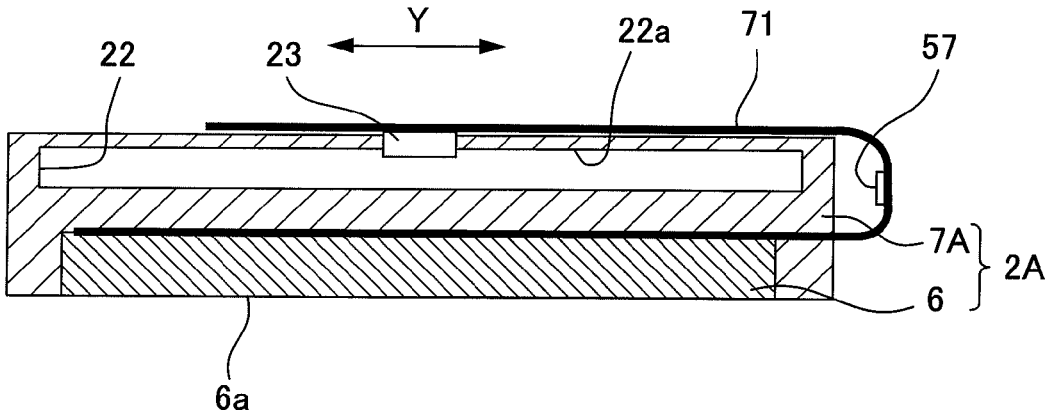
FIG. 10 is a cross-sectional view corresponding to FIG. 3, of an ink-jet head of a first modified embodiment.

According to such arrangement, since the FPC 71 for supplying the drive signal to the head main body 6 is drawn in Y direction intersecting (orthogonal to) X direction (direction in which the air channel 22 is extended), the FPC 71 does not interfere with the air inlet and outlet ports 20 and 21 which open in X direction (a frontward side of a paper surface and a rearward side of a paper surface in FIG. 10), and does not hinder an inflow and an outflow of outside air through the air channel 22. Moreover, the FPC 71 being electrically connected to the wind velocity sensor 23, there is no need to provide a separate cable for connecting the wind velocity sensor 23 to the control unit 5, and an electrical structure is simplified.

Second Modified Embodiment

Figure 11:
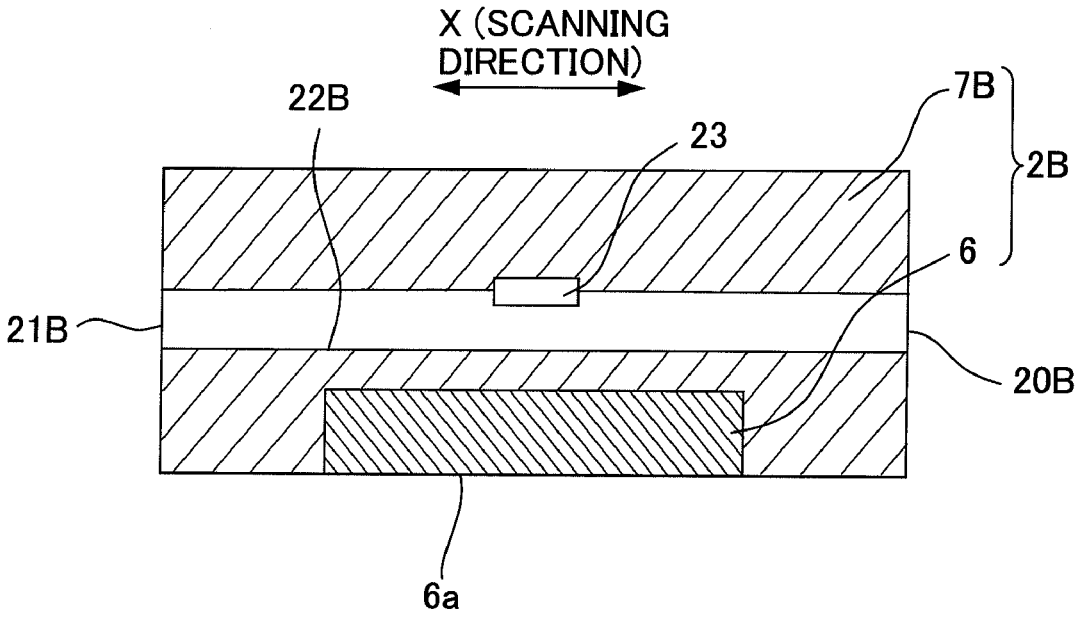
FIG. 11 is a cross-sectional view corresponding to FIG. 4, of an ink-jet head of a second modified embodiment.

As shown in FIG. 11, an air channel 22B may be extended in X direction over an entire length, and two air inlet and outlet ports 20B and 21B which communicate with the air channel 22B may open on two end surfaces respectively in X direction of an ink-jet head 2B (head holder 7B). According to such structure, the air inlet and outlet ports 20B and 21B are positioned (move further) away from the liquid droplet jetting surface 6*a* as compared to the (position in the) embodiment (FIG. 4), but it is advantageous from a point that, it is possible to fetch smoothly a part of the air which flows in near the liquid droplet jetting surface 6*a*.

Third Modified Embodiment

Figure 12:
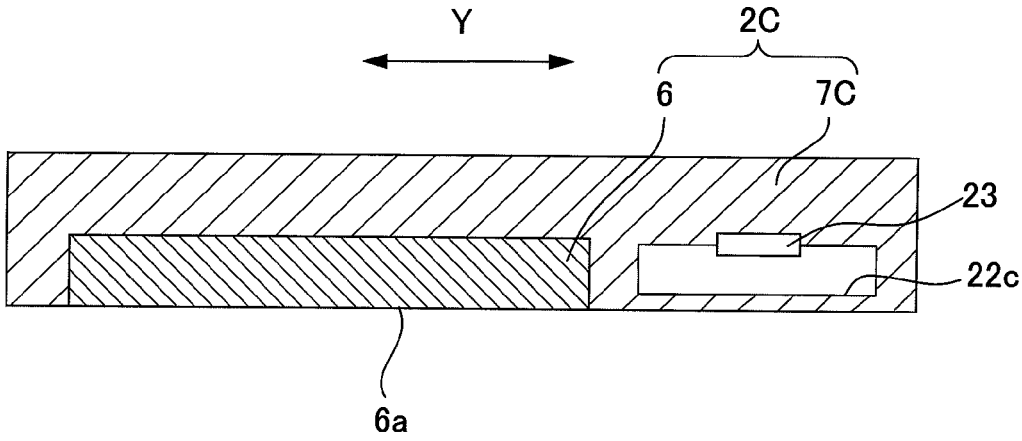
FIG. 12 is a cross-sectional view corresponding to FIG. 3, of an ink-jet head of a third modified embodiment.

In the embodiment, with an object of suppressing the ink from entering the air channel 22, the two air inlet and outlet ports 20 and 21 which communicate with the air channel 22 have been positioned away (have been separated away) upward from the liquid droplet jetting surface 6*a* (opposite side of the direction of jetting of liquid droplets) (refer to FIG. 4). However, as shown in FIG. 12, an air channel 22C provided to an ink-jet head 2C, and air inlet and outlet ports (20C and 21C) which communicate with the air channel 22C may be positioned away (separated away) in a horizontal direction (such as Y direction) from the head main body 6 having the liquid droplet jetting surface 6*a*.

Fourth Modified Embodiment

Figure 13:
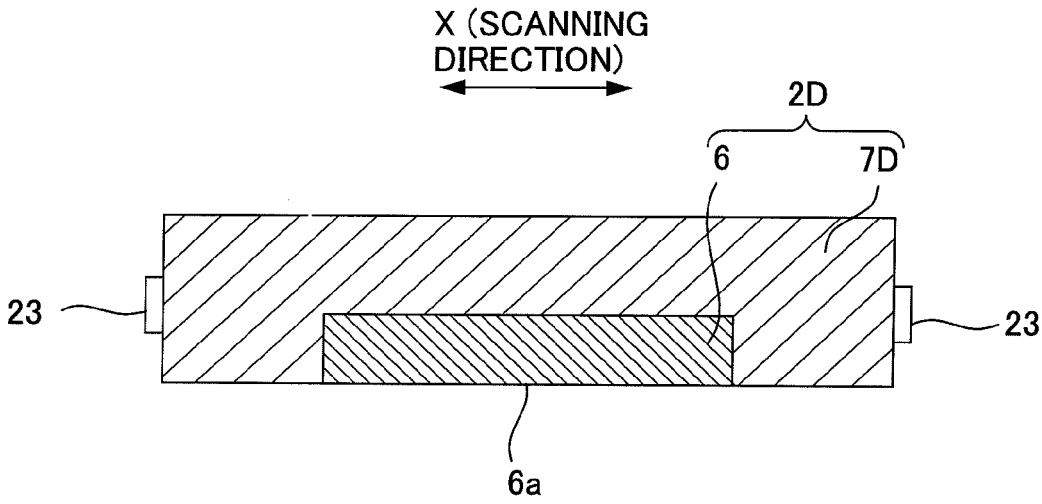
FIG. 13 is a cross-sectional view corresponding to FIG. 4, of an ink-jet head of a fourth modified embodiment.

The wind velocity sensor 23 is not particularly required to be arranged in the air channel which is provided inside the ink-jet head, and may be provided on a surface (an outer surface) of the ink-jet head. For instance, as shown in FIG. 13, two wind velocity sensors 23, one each on each end surface in X direction of a head holder 7D of an ink-jet head 2D may be provided.

Fifth Modified Embodiment

Figure 14:
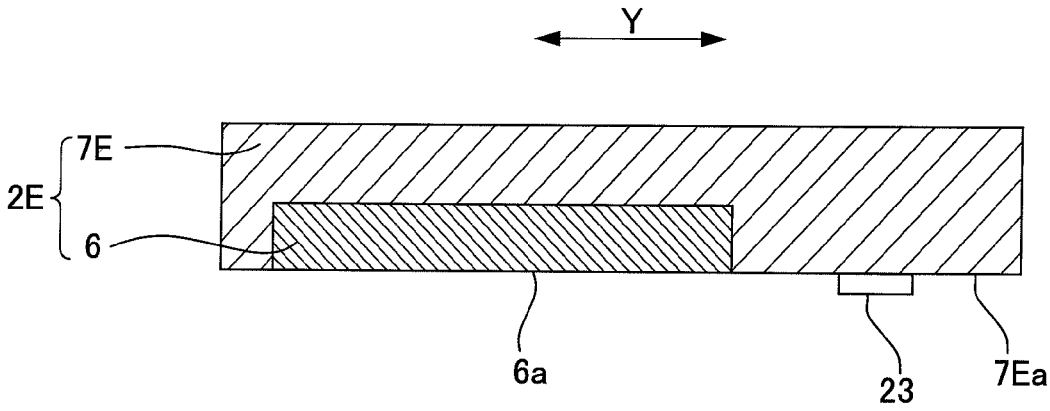
FIG. 14 is a cross-sectional view corresponding to FIG. 3, of an ink-jet head of a fifth modified embodiment.

When the wind velocity sensor 23 is provided on the surface (outer surface) of the ink-jet head, for finding correctly the wind velocity near the liquid droplet jetting surface 6*a*, it is preferable that the wind velocity sensor 23 is provided on the same surface as the liquid droplet jetting surface 6*a*. For instance, as shown in FIG. 14, a head holder 7E of an ink-jet head 2E may have a surface communicating with the liquid droplet jetting surface 6*a* of the head main body 6, on the same surface, and a surface on which the nozzle 40 is not arranged (non-jetting surface 7Ea), and the wind velocity sensor 23 may be provided on this non-jetting surface 7Ea.

According to such arrangement, since the surface on which the wind velocity sensor 23 is provided is on the surface communicating with the liquid droplet jetting surface 6*a* on the same surface, wind velocity condition near the wind velocity sensor 23 becomes substantially close to wind velocity condition near the liquid droplet jetting surface 6*a*, and it is possible to find more correctly the wind velocity near the liquid droplet jetting surface 6*a*. Moreover, the surface on which the wind velocity sensor 23 is provided is the non-jetting surface 7Ea on which the nozzle 40 is not arranged, the ink is hardly adhered to the wind velocity sensor 23.

Sixth Modified Embodiment

The ink-jet head 2 of the embodiment has been a serial ink-jet head jetting liquid droplets on a printing medium while reciprocating in a predetermined direction. However, as shown in FIG. 15, the ink-jet head may be a line ink-jet head which jets liquid droplets on the printing medium 10 transported by rollers 81, 82, and 83, from a plurality of nozzles arranged in a row to be extended over entire area in a direction of width of the printing medium, in a lower surface in a state of being positioned and fixed with respect to an apparatus main body 80.

Figure 15:
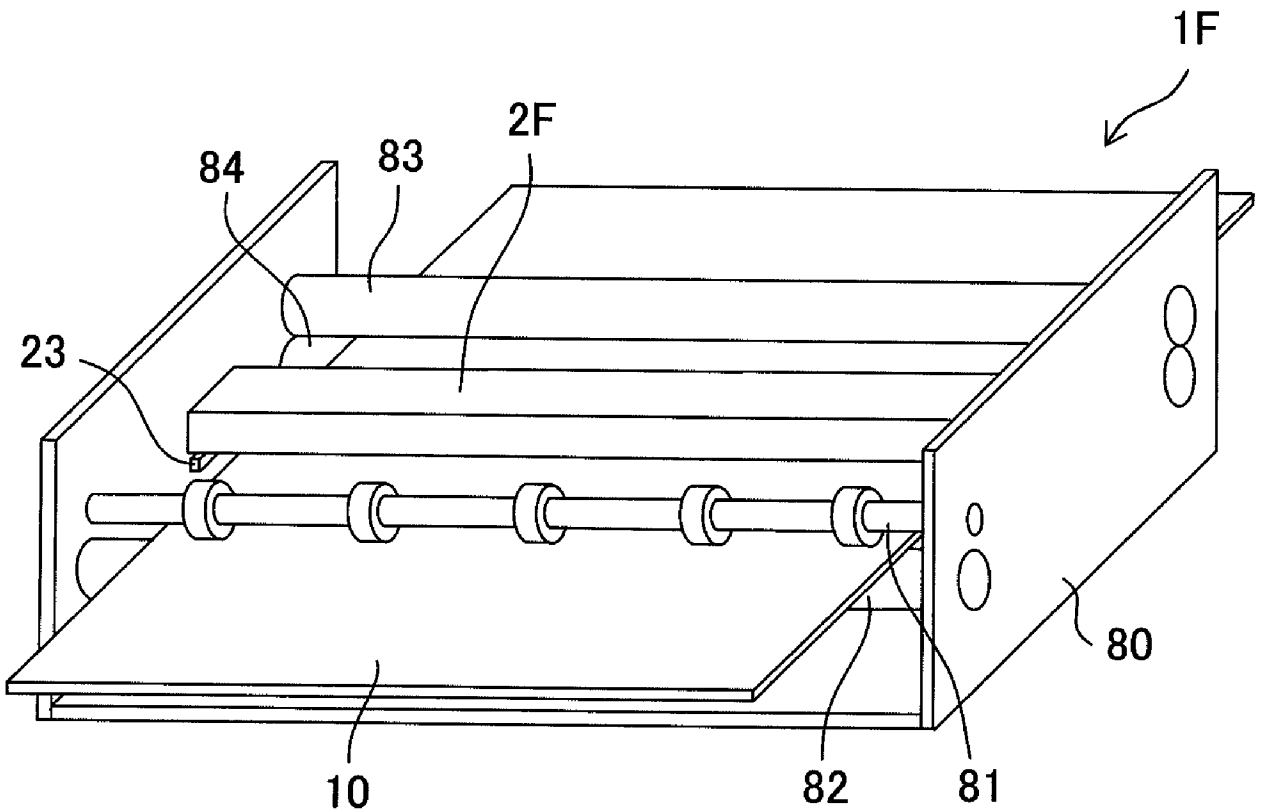
FIG. 15 is a schematic structural view of a printer of a sixth modified embodiment which includes a line ink-jet head.

Moreover, the wind velocity sensor 23 may be provided to the line ink-jet head, and as shown in FIG. 15, or the wind velocity sensor 23 may be provided to the apparatus main body 80 of a printer 1F which supports an ink-jet head 2F.

Seventh Modified Embodiment

Figure 16A:
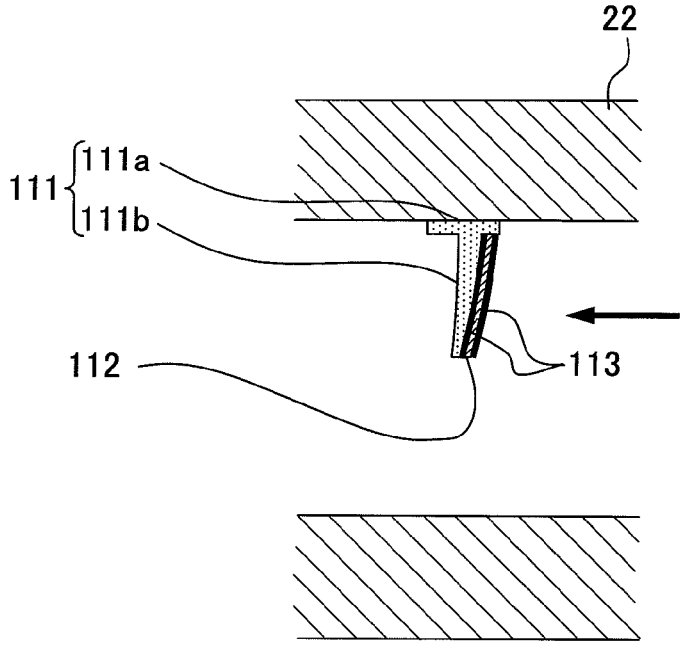
FIG. 16A is a schematic structural view of a first example of MEMS and FIG. 16B is a schematic view of a second example of MEMS.

In the embodiment and the modified embodiments described above, a thermistor has been used as the wind velocity sensor. However, the wind velocity sensor is not restricted to a thermistor. For example, replacing the thermistor, a micro electro-mechanical system (MEMS) may be used. As an example of the MEMS, a wind velocity sensor 110 shown in FIG. 16A may be used. Here, the wind velocity sensor 110 includes a substrate 111 which is flexible and insulating, having a base portion 111*a* in the form of a plate, and a fin 111*b* of which one end is fixed to the base portion 111*a*, and which is extended in a direction intersecting a planar direction of the base portion 111*a*, a piezoelectric material layer 112 of a material such as PZT stacked on the fin 111*b* of the substrate 111, and a set of electrodes 113 sandwiching the piezoelectric material layer 112 in a stacking direction. The piezoelectric material layer 112 is polarized in advance in the stacking direction. For instance, in a case of arranging the wind velocity sensor 110 replacing the wind velocity sensor 23 of thermistor type arranged on the upper surface of the outside-air channel 22 in the embodiment described above, the base portion 111*a* of the substrate 11 is fixed to the upper surface of the air channel 22. At this time, the fin 111*b* is projected (is protruded) toward inner side of the air channel 22. When a flow of air is generated at an interior of the air channel 22, the fin 111*b* is deformed due to a wind pressure. The piezoelectric material layer 112 is deformed with the deformation of the fin 111*b*, and an electromotive force is generated in the set of electrodes 113 arranged sandwiching the piezoelectric material layer 112. A magnitude of the electromotive force is related to a magnitude of the deformation of the piezoelectric material layer 112, and the magnitude of the deformation of the piezoelectric material layer 112 is related to the wind velocity. In other words, since the magnitude of the electromotive force generated between the electrodes 113 is related to the wind velocity, by measuring the electromotive force accurately, it is possible to find a velocity of the flow of air flowing through the air channel 22.

Figure 16B:
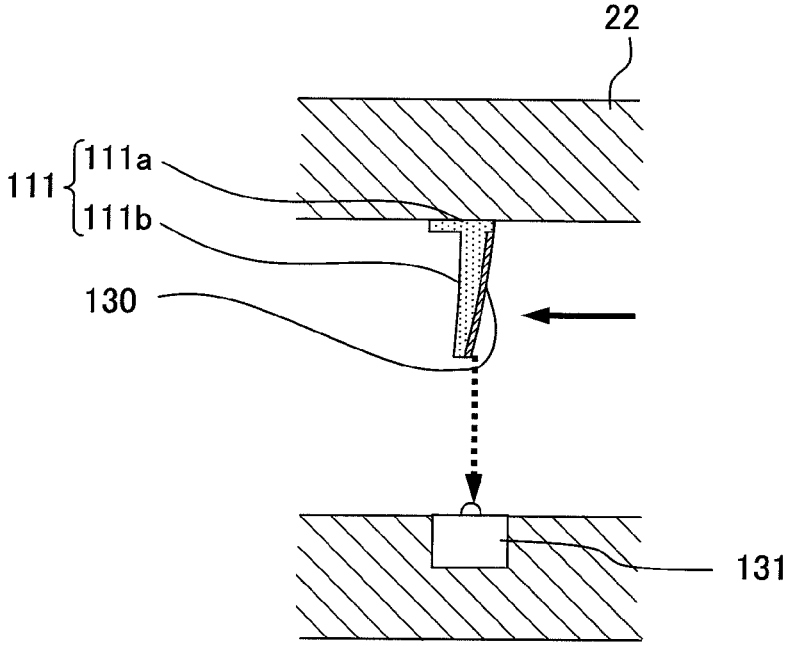

Or, as another example of MEMS, it is also possible to use a wind velocity sensor 120 in which a stress luminescent element is used. As shown in FIG. 16B, the wind velocity sensor 120 includes the substrate 111, a stress luminescent element 130 which is applied to the fin portion 111*b* of the substrate 111, and a light receiving sensor 131 which receives light emitted from the stress luminescent element 130. Here, it is possible to form the stress luminescent element 130 by stress luminescent materials shown below. As a stress luminescent material, for example, it is possible to use a material in which, europium (Eu) (rare-earth substance) which is a luminescence center is added to $Sr_3Al_2O_6$ (aluminate) which is a host material, or a material in which, neodymium (Nd) (transition metal substance) which is a luminescence center is added to $Ca_3Al_2O_6$ (aluminate) which is a host material. Apart from this, it is possible to use materials such as $Sr_{0.90}Al_2O_{3.90}$:$Eu_{0.01}$ (refer to Japanese Patent Application Laid-open No. 2000-63824), $Ca_2Al_2SiO_7$:Ce, $Ca_2MgSi_2O_7$:Ce (refer to Japanese Patent Application Laid-open No. 2001-49251), and $ZnAl_2O_4$:Mn, $BaAl_2O_4$:Ce (refer to Japanese Patent Application Laid-open No. 2001-64638). More concretely, it is possible to manufacture a stress luminescent material by adding 0.6 wt % of Eu which is a luminescence center and 1 wt % of boric acid as a flux to $Sr_3Al_2O_6$ which is a host material, and baking this mixture in a reducing atmosphere (Ar+$H_2$ 5%) for approximately four hours at 1300° C., and it is possible to use upon powdering the resultant material.

The fin 111*b* provided with the stress luminescent element 130, as described above, is deformed by bending in the direction of flow of air with a magnitude according to (corresponding to) the wind velocity. When the fin 111*b* is deformed by bending in such manner, the stress luminescent element 130 is subjected to a stress of a magnitude corresponding to the wind velocity of the flow of air, and emits light of a luminance corresponding to a change of stress which is exerted. In a precise sense, the luminance (the intensity) of the stress luminescent element 130 changes in correlation with an amount of change of stress per unit time (stress velocity). By measuring the change in the luminance of the stress luminescent element 130 by the light receiving sensor 131, it is possible to find the velocity of flow of air flowing through the outside-air channel 22.

In the seventh modified embodiment, the substrate 111 may be formed of a flexible material and may not be necessarily formed of an insulating material. For instance, when the substrate 111 is formed of a metal, by forming the piezoelectric material layer 112 directly on the fin 111*b* of the substrate 111, it is possible to use the upper surface of the fin 111*b* as a part of the electrode 113. Moreover, in a case of using a stress luminescent element and a case of forming the substrate 111 by a transparent material, since it is possible to arrange the light receiving sensor 131 to receive light through the substrate 111, a degree of freedom of arranging the light receiving sensor 131 becomes high. The stress luminescent element is not restricted to be applied to the upper surface of the fin 111*b* of the substrate 111, and at the time of forming the substrate 111 which is transparent, it may be formed integrally by kneading a stress luminescent material. In this case, since the fin 111*b* emits light by bending deformation (deformation by bending) of the fin 111*b*, it is possible to measure the wind velocity by receiving this light by the light receiving sensor 131. Moreover, the stress luminescent element and the piezoelectric material layer may not be necessarily provided to the fin of the substrate. The stress luminescent element and the piezoelectric material layer may be provided to a portion of the substrate which is deformed upon receiving the flow of the wind. A shape and a material of the substrate may be arbitrary, provided that it has a portion that is deformed upon receiving the flow of wind.

In the MEMS of the seventh modified embodiment, it is possible to measure not only the magnitude of the wind velocity but also a direction of the wind velocity. For instance, by arranging two wind velocity sensors 110 (120) such that the fins 111*b* face in two different directions, it is possible to measure a component of the wind velocity in these two directions. For example, in a case of arranging the wind velocity sensor on the non-jetting surface 7Ea of the head holder 7E as in the fifth modified embodiment, the two wind velocity sensors 110 (120) may be arranged to be facing in the scanning direction of the ink-jet head 2E and a direction orthogonal to the scanning direction respectively. In this case, it is possible to measure not only the wind velocity along the scanning direction but also the wind velocity in the direction orthogonal to the scanning direction (direction in which the nozzle row is extended).

Figure 17:
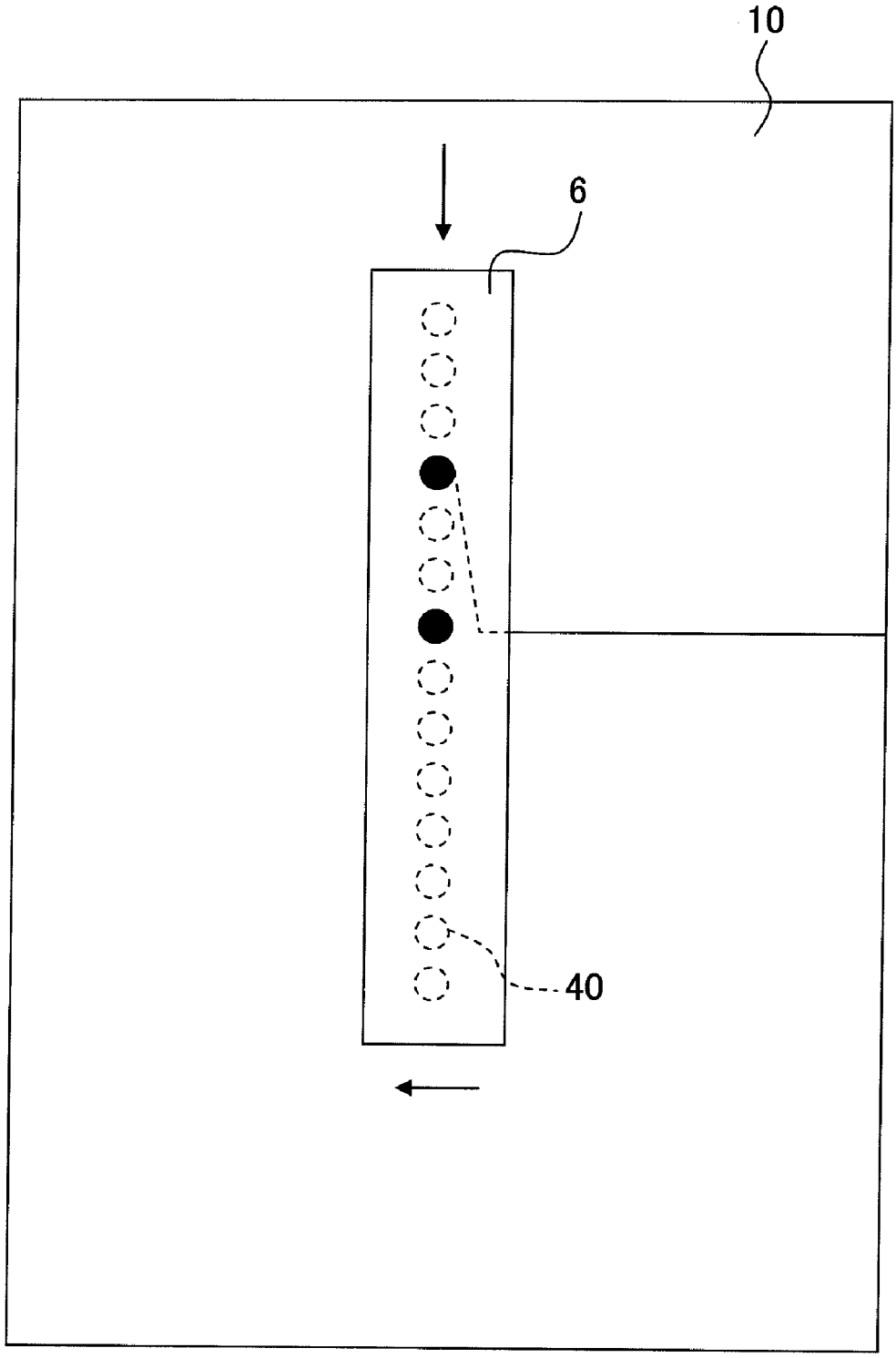
FIG. 17 is schematic view showing an effect of the wind blowing in the nozzle-array direction.

As it has been described above, when the wind velocity of the wind flowing in the direction in which the nozzle rows are extended (hereinafter, called as only 'nozzle row direction') has been measured, for making small an effect of the flow of wind in the nozzle row direction, it is possible to carry out a control described below. For instance, as shown in FIG. 17, it is assumed that a wind flowing downward from an upper side is detected when a straight line is described by jetting the ink continuously from a seventh nozzle from the top while scanning the ink-jet head. At this time, by measuring the wind velocity of this wind, it is known as to what extent the droplets of ink are flowed downward in FIG. 17. For example, when it is anticipated to flow by an amount equivalent to three nozzles, by making the ink jet from a fourth nozzle from the top instead of the seventh nozzle from the top, it is possible to suppress the effect of the wind flowing in the nozzle row direction.

Eighth Modified Embodiment

In the embodiment and the modified embodiments described above, the wind velocity sensor has been measuring the wind velocity all the time (continuously), and the jetting control section 60 has been adjusting (controlling) the waveform and the voltage value etc. of the drive signal based on the latest wind-velocity data. However, the present invention is not restricted to this, and for example, the wind velocity sensor (or the control unit) may have a memory, and the data of wind velocity which is measured may be stored in the memory. At this time, in a case of obtaining position information of the ink-jet head 2 from an encoder for example, by associating the wind-velocity data and the position information of the ink-jet head 2 at that time, and storing in the memory, it is possible to compute a distribution of the wind velocity (wind velocity map). For example, when the ink-jet head is a serial ink-jet head which reciprocates in a predetermined scanning direction, it is possible to measure in advance the wind velocity at each position in the scanning direction, and to find the wind-velocity distribution in the scanning direction. After the wind-velocity distribution is obtained, even without measuring the wind velocity all the time (continuously), the jetting control section 60 may adjust the waveform and the voltage value of the drive signal based on the wind-velocity distribution which is measured in advance. Or, while measuring the wind velocity all the time (continuously), the jetting control section 60 may adjust the waveform and the voltage value etc. of the drive signal based on the wind-velocity information which is measured at the time of previous scanning.

Ninth Modified Embodiment

In the embodiment described above, the wind velocity sensor of a thermistor type has been used. As it has been described above, in the thermistor-type wind velocity sensor, the wind velocity is detected by using a phenomenon that the resistance value of the thermistor fluctuates (changes) by the heat on the thermistor surface being removed (drawn) by the flow of air. Here, without restricting to the thermistor type, it is possible to use a temperature sensor which measures a temperature of a sensor surface, as the wind velocity sensor. For example, in a case of the serial ink-jet head, first the temperature is measured when stationary (in a stationary state) (stationary temperature). When the temperature measured at the time of scanning the ink-jet head is lower than the stationary temperature, since it is considered that the flow of air has been generated, similarly as in the embodiment described above, the jetting control section 60 is capable of adjusting the waveform and the voltage value etc. of the drive signal.

Examples in which the present invention is applied to an ink-jet head which makes jet droplets of ink from nozzles have been described as the embodiment (and the modified embodiments) of the present invention. However, the application of the present invention is not restricted to such ink-jet heads. For example, the present invention is applicable to a liquid droplet jetting apparatus having a head in which one nozzle is formed. Further, the present invention is also applicable to liquid droplet jetting apparatuses which are used in various fields, jetting liquids other than ink, such as drug solutions and chemical solutions toward a substrate etc. Furthermore, the present invention is also applicable to a liquid droplet jetting apparatus which jets electroconductive liquids onto a substrate to form a wiring thereon. In this case, the liquid droplet jetting apparatus may have a single nozzle for jetting the electroconductive liquids, or may have a plurality of nozzles for jetting the electroconductive liquids.

What is claimed is:

1. A liquid droplet jetting apparatus which jets a liquid droplet onto a medium, comprising:

a liquid droplet jetting head having a liquid droplet jetting surface having a nozzle through which the liquid droplet is jetted;

a wind-velocity detecting mechanism which measures a wind-velocity at an area around the liquid droplet jetting head; and a jetting control mechanism which controls a liquid droplet jetting operation of the liquid droplet jetting head, and which adjusts a drive signal for driving the liquid droplet jetting head based on the wind-velocity measured by the wind-velocity detecting mechanism, wherein the jetting control mechanism has a wind-velocity storage section which stores the wind velocity measured by the wind-velocity detecting mechanism while associating the measured wind velocity with a relative position of the liquid droplet jetting head relative to the medium; and the jetting control mechanism adjusts the drive signal based on the wind velocity stored in the wind-velocity storage section and the relative position associated with the stored wind velocity.

2. The liquid droplet jetting apparatus according to claim 1, wherein the area around the liquid droplet jetting head is an area located between the medium and the liquid droplet jetting surface.

3. The liquid droplet jetting apparatus according to claim 1, wherein when the wind velocity detected by the wind-velocity detecting mechanism is zero, the jetting control mechanism supplies to the liquid droplet jetting head the drive signal with a reference voltage, and when the wind velocity detected by the wind-velocity detecting mechanism is not zero, the jetting control mechanism supplies to the liquid droplet jetting head the drive signal with a voltage higher than the reference voltage, while setting that a voltage difference between the voltage and the reference voltage increases according to a magnitude of the wind velocity detected by the wind-velocity detecting mechanism.

4. The liquid droplet jetting apparatus according to claim 1, wherein when the wind velocity detected by the wind-velocity detecting mechanism is zero, the jetting control mechanism supplies to the liquid droplet jetting head the drive signal with a reference pulse width; and when the wind velocity detected by the wind-velocity detecting mechanism is not zero, the jetting control mechanism supplies to the liquid droplet jetting head the drive signal with a pulse width larger than the reference pulse width, while setting that a difference between the pulse width and the reference pulse width increases according to a magnitude of the wind velocity detected by the wind-velocity detecting mechanism.

5. The liquid droplet jetting apparatus according to claim 1, wherein when the wind velocity detected by the wind-velocity detecting mechanism is zero, the jetting control mechanism supplies to the liquid droplet jetting head the drive signal at a reference timing; and when the wind velocity detected by the wind-velocity detecting mechanism is not zero, the jetting control mechanism supplies to the liquid droplet jetting head the drive signal at a timing shifted from the reference timing, while setting that the time shift between the timing and the reference timing increases according to a magnitude of the wind velocity detected by the wind-velocity detecting mechanism.

6. The liquid droplet jetting apparatus according to claim 1, wherein the liquid droplet jetting head jets the liquid droplet from the nozzle while moving along a predetermined scanning direction; and the wind-velocity detecting mechanism is provided on the liquid droplet jetting head, and measures a wind velocity at an area around the liquid droplet jetting head, while moving integrally with the liquid droplet jetting head in the scanning direction, during a liquid droplet jetting operation of the liquid droplet jetting head.

7. The liquid droplet jetting apparatus according to claim 6, wherein the liquid droplet jetting head is provided with two air inlet/outlet ports, which are open on both sides in the scanning direction respectively, and an air channel which is extended in the scanning direction to connect the two air inlet/outlet ports; and the wind-velocity detecting mechanism is arranged inside the air channel.

8. The liquid droplet jetting apparatus according to claim 7, wherein the wind-velocity detecting mechanism is arranged on a ceiling surface of the air channel.

9. The liquid droplet jetting apparatus according to claim 7, further comprising a wire member which is flexible and connected to the liquid droplet jetting head and through which the drive signal to the liquid droplet jetting head is supplied; and the wire member is drawn in a direction intersecting the scanning direction, and is bent in a direction opposite to a liquid droplet jetting direction, with respect to the liquid droplet jetting surface of the liquid droplet jetting head; and the wind-velocity detecting mechanism provided inside the air channel is electrically connected to the wire member.

10. The liquid droplet jetting apparatus according to claim 7, wherein in a liquid droplet jetting direction directed from the liquid droplet jetting surface toward the medium, the two air inlet/outlet ports are arranged on the liquid droplet jetting head at positions closer to the liquid droplet jetting surface than the air channel; and end portions of the air channel which communicate with the two air inlet/outlet ports respectively, are extended such that each of the end portions is inclined toward one of the air inlet/outlet ports.

11. The liquid droplet jetting apparatus according to claim 7, wherein portions of a surface of the liquid droplet jetting head, on which the two air inlet/outlet ports are provided respectively are inclined with respect to the liquid droplet jetting surface in a direction opposite to the liquid droplet jetting direction.

12. The liquid droplet jetting apparatus according to claim 6, wherein the air channel has a channel shape symmetrical in the scanning direction with a central portion thereof as a center of symmetry, and the wind-velocity detecting mechanism is arranged in the air channel at the central portion in the scanning direction.

13. The liquid droplet jetting apparatus according to claim 6, wherein the air inlet/outlet ports and the liquid droplet jetting surface are aligned in the scanning direction.

14. The liquid droplet jetting apparatus according to claim 6, wherein the wind-velocity detecting mechanism has a temperature sensor which detects a temperature around the temperature sensor, and a wind-velocity calculating section which calculates the wind velocity based on the temperature measured by the temperature sensor; and the wind-velocity calculating section calculates the wind velocity based on a temperature difference between a stationary temperature measured by the temperature sensor in a state that the liquid droplet jetting head is stationary before moving in the scanning direction, and a scanning temperature measured by the temperature sensor when the liquid droplet jetting head moves in the scanning direction, and the jetting control mechanism adjusts the drive signal based on the wind velocity calculated by the wind-velocity calculating section.

15. The liquid droplet jetting apparatus according to claim 1, wherein the liquid droplet jetting head jets the liquid droplet from the nozzle while moving in a predetermined scanning direction; and the relative position is a relative position of the liquid droplet jetting head relative to the medium in the scanning direction, and the jetting control mechanism calculates a wind-velocity distribution based on the wind velocity stored in the wind-velocity storage section and the relative position in the scanning direction associated with the wind velocity, and the jetting control mechanism adjusts the drive signal based on the wind-velocity distribution.

16. The liquid droplet jetting apparatus according to claim 1, wherein the jetting control mechanism adjusts a waveform of the drive signal based on the wind-velocity measured by the wind-velocity detecting mechanism.

17. A liquid droplet jetting apparatus which jets a liquid droplet onto a medium, comprising:

a liquid droplet jetting head having a liquid droplet jetting surface having a nozzle through which the liquid droplet is jetted;

a wind-velocity detecting mechanism which measures a wind-velocity at an area around the liquid droplet jetting head; and a jetting control mechanism which controls a liquid droplet jetting operation of the liquid droplet jetting head, and which adjusts a drive signal for driving the liquid droplet jetting head based on the wind-velocity measured by the wind-velocity detecting mechanism, wherein the liquid droplet jetting head jets the liquid droplet from the nozzle while moving along a predetermined scanning direction, the wind-velocity detecting mechanism is provided on the liquid droplet jetting head, and measures a wind velocity at an area around the liquid droplet jetting head, while moving integrally with the liquid droplet jetting head in the scanning direction, during a liquid droplet jetting operation of the liquid droplet jetting head;

the liquid droplet jetting apparatus further comprises a wiper which is movable in the scanning direction relative to the liquid droplet jetting surface, while making a contact with the liquid droplet jetting surface of the liquid droplet jetting head, and which is capable of wiping off the liquid adhered to the liquid droplet jetting surface, and the two air inlet/outlet ports are arranged on the liquid droplet jetting head at a position which is away from a position contacted by the wiper.

18. The liquid droplet jetting apparatus according to claim 17, wherein each of the two air inlet/outlet ports is arranged on the liquid droplet jetting head at a position away from the liquid droplet jetting surface in a direction opposite to the liquid droplet jetting direction.

19. A liquid droplet jetting apparatus which jets a liquid droplet onto a medium, comprising:

a liquid droplet jetting head having a liquid droplet jetting surface having a nozzle through which the liquid droplet is jetted;

a wind-velocity detecting mechanism which measures a wind-velocity at an area around the liquid droplet jetting head; and a jetting control mechanism which controls a liquid droplet jetting operation of the liquid droplet jetting head, and which adjusts a drive signal for driving the liquid droplet jetting head based on the wind-velocity measured by the wind-velocity detecting mechanism, wherein the area around the liquid droplet jetting head is an area located between the medium and the liquid droplet jetting surface, the liquid droplet jetting head has a non jetting surface which communicates with the liquid droplet jetting surface on a same plane, and in which the nozzle is not arranged, and the wind-velocity detecting mechanism is provided on the non jetting surface.

* * * * *